US005361937A

United States Patent [19]

Wiese

[11] Patent Number: 5,361,937

[45] Date of Patent: Nov. 8, 1994

[54] ARTICULATED GRAVITY FEED MODULE

[75] Inventor: Lee R. Wiese, Upper Nyack, N.Y.

[73] Assignee: Henschel-Steinau, Inc., Englewood, N.J.

[21] Appl. No.: 148,565

[22] Filed: Nov. 8, 1993

[51] Int. Cl.[5] ..... G07F 11/48

[52] U.S. Cl. ..... 221/189; 221/130; 221/281; 221/285; 221/288; 211/59.2; 211/150

[58] Field of Search ..... 221/64, 65, 123, 124, 221/130, 174, 186, 188, 189, 191, 193, 194, 197, 281, 285, 286, 287, 288; 211/59.2, 150; 186/2, 4

[56] References Cited

U.S. PATENT DOCUMENTS

| | | | |
|---|---|---|---|
| 617,284 | 1/1899 | Darnes . | |
| 1,284,319 | 11/1918 | Grover | 221/281 X |
| 1,343,974 | 6/1920 | Jandron . | |
| 1,374,451 | 4/1921 | Heyman . | |
| 1,459,850 | 6/1923 | Moore . | |
| 1,694,897 | 12/1928 | Washburn . | |
| 1,753,957 | 4/1930 | Washburn . | |
| 1,966,676 | 7/1934 | Marsh . | |
| 2,661,991 | 12/1953 | Petrecca | 221/281 X |
| 2,680,663 | 6/1954 | Geller . | |
| 2,692,053 | 10/1954 | Calhoun et al. . | |
| 3,010,606 | 11/1961 | Heselov . | |
| 3,194,433 | 7/1965 | Heselov . | |
| 3,194,620 | 7/1965 | Sauer . | |
| 3,265,246 | 8/1966 | Messenger . | |
| 3,404,927 | 10/1968 | Mellion . | |
| 3,776,419 | 12/1973 | Zinkgraf et al. | 221/197 |

FOREIGN PATENT DOCUMENTS

| | | | |
|---|---|---|---|
| 513791 | 9/1952 | Belgium | 221/197 X |
| 394398 | 4/1991 | Japan | 221/281 X |
| 96938 | 2/1961 | Netherlands | 211/59.2 X |
| 333360 | 8/1930 | United Kingdom | 221/287 X |

*Primary Examiner*—Robert P. Olszewski
*Assistant Examiner*—Dean A. Reichard
*Attorney, Agent, or Firm*—Samuelson & Jacob

[57] ABSTRACT

An articulated gravity feed module includes a curved chute for holding items for sale, the chute having a curved bottom wall with a radius of curvature decreasing from a rear portion to a front portion, and side walls connected with the bottom wall; a mounting assembly mounting the chute to a wall; a hopper for supplying items to the chute, the hopper including an elongated enclosure having an open upper end for restocking the items and an open lower end which is always open to the chute for depositing items on the chute, the elongated enclosure being formed by a rear wall, a front wall and interconnecting side walls, the rear wall having a lower portion with a radius of curvature similar to that of the rear portion of the bottom wall of the chute so that the lower portion of the rear wall rides along the rear portion of the bottom wall of the chute; pivot pins pivotally securing the hopper to the chute at a position above the chute, such that the hopper is pivotable between an upright dispensing position adjacent the wall and a restocking position positioned away from the wall; and a limit mechanism limiting pivotal movement of the hopper with respect to the chute, the limit mechanism including an elongated slot in the rear portion of the bottom wall of the chute and a stop pin mounted on the lower portion of the rear wall for engagement within the elongated slot.

5 Claims, 2 Drawing Sheets

FIG. 1
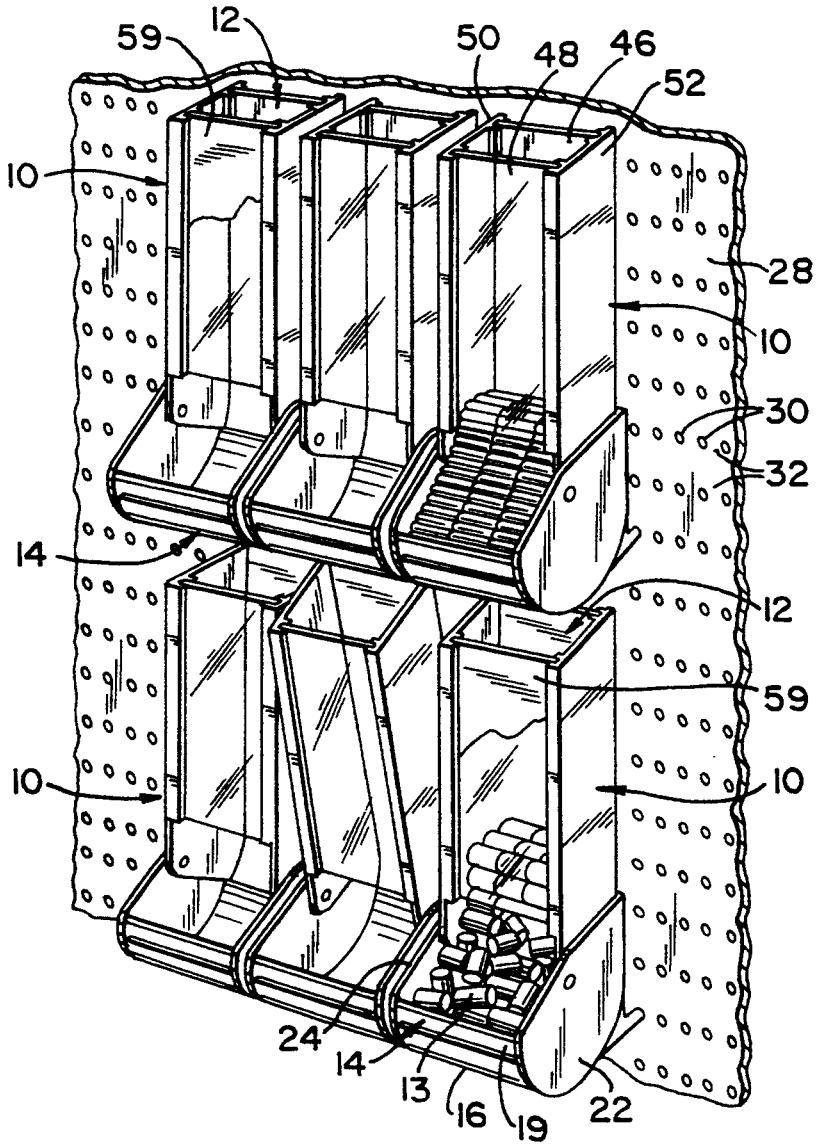
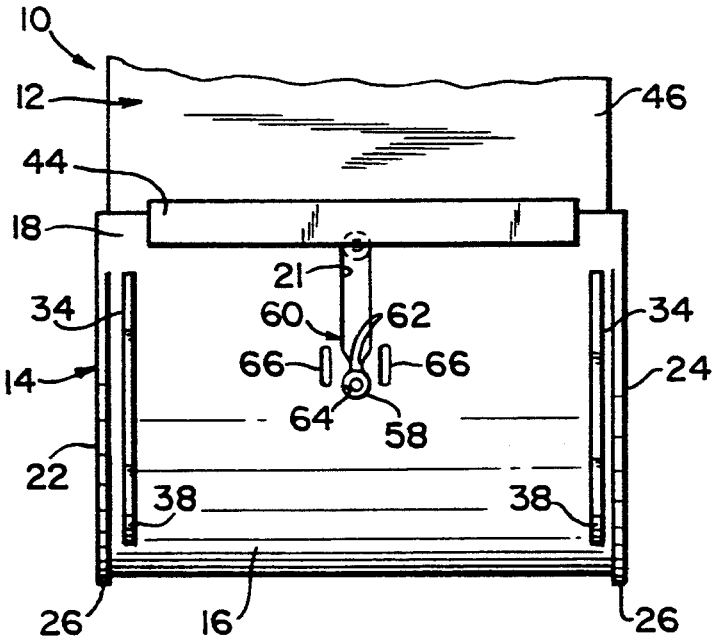
FIG. 4

ARTICULATED GRAVITY FEED MODULE

BACKGROUND OF THE INVENTION

1. Field of the Invention

The present invention relates generally to inventory dispensing apparatus, and particularly, is directed to an articulated gravity feed module for dispensing loose items for sale.

2. Description of the Prior Art

It is well known to provide a gravity feed dispenser for dispensing small loose items for sale. Such dispensers are generally fixed to a wall. These dispensers include an elongated hopper within which the items are held in a loose stacked relation, and a lower curved hook-like chute positioned below the open lower end of the elongated hopper. Generally, the front end of the lower chute is spaced from the open lower end at the front of the hopper, while the rear end of the lower chute is connected with the rear lower end of the hopper. Thus, the items slide down the hopper onto the upper surface of the chute, where the items are presented for removal by a purchaser. Examples of such apparatus are described in U.S. Pat. Nos. 1,374,451 (Heyman), 1,343,974 (Jandron), 1,694,897 (Washburn), 1,753,957 (Washburn), 2,680,663 (Geller), 2,692,053 (Calhoun et al) and 3,265,246 (Messenger). See also U.S. Pat. Nos. 617,284 (Darnes), 1,966,676 (Marsh), 3,194,620 (Sauer) and 3,404,927 (Mellion) for similar devices.

U.S. Pat. No. 2,680,663 (Geller) discloses a dispensing rack in which the hopper is fixed to a wall, and the lower hook-shaped chute or scoop is pivotally biased upwardly into closing relation with the lower open end of the hopper, to prevent escape of clothespins held on the lower hook-shaped chute. In order to remove the clothespins, the chute is pivoted downwardly against the force of a spring, thereby creating an opening for removal of the clothespins.

In order to restock the hoppers of the above devices upon depletion of items, new items are supplied through the open, upper end of each elongated hopper. In the situation where there is only one such dispenser or where there are many dispensers spaced far apart from each other, there is no problem in restocking the items through the open upper end of each hopper. However, when there are multiple dispensers grouped close to each other, the chute of one dispenser may be positioned very close to the open upper end of the hopper of the next lower dispenser, thus making restocking of the lower dispenser difficult.

In the case where the items for sale have flat sides, such as cigarette packages, that permit the items to be neatly stacked one on top of the other in the hopper, the front faces of the hoppers can be kept open for restocking purposes. Examples of such dispensers are described in U.S. Pat. Nos. 3,010,606 (Heselov) and 3,194,433 (Heselov). However, where the items cannot be stacked neatly one on top of the other in such fashion, it is necessary to Close the front faces of the hoppers to prevent escape of the items from the hoppers.

U.S. Pat. No. 1,459,850 (Moore) discloses a dispenser for dispensing matches, in which the upper casing or hopper which holds the matches above hook-shaped holders or chutes, can be pivoted downwardly about a pivot point at its lower rear end for restocking. However, with such arrangement, the rear face of the upper casing is completely open during the pivoting movement. As a result, to prevent the matches from escaping when the upper casing is pivoted back to its operative position, it is necessary to provide an additional removable cover plate for the restocking operation. Further, the lower end of the upper casing is not normally open so that the matches do not normally rest on the hook-shaped holders. Rather, a separate release mechanism must be provided for releasing one match at a time, which falls onto the hook-shaped holders.

SUMMARY OF THE INVENTION

The present invention provides an articulated gravity feed module which avoids many of the problems encountered in the above-outlined inventory dispensers and exhibits several objects and advantages, some of which may be summarized as follows. First, with the present invention, a plurality of articulated gravity feed modules can be placed in close proximity to each other, without hindering the removal of items from the lower hook-shaped chute or the restocking of items into the hopper of each module. This is because the elongated hopper is tiltable about its lower end to move the upper open end of the hopper outwardly of the supporting wall. In this position, new items can be deposited through the upper open end of the hopper, particularly in view of the closed rear wall of the hopper. Secondly, the lower rear wall of the hopper is slidably engaged with the upper rear wall of the hook-shaped chute, and thereby pivots along the radius of the upper rear wall of the chute. This means that the rear walls of the hopper and chute always form an effectively continuous wall having a smooth transition. Third, the lower end of the hopper is always open so that the items are always deposited immediately upon the upper surface of the chute for removal by a purchaser. There is thus no need for any additional mechanism to release the items onto the chute.

The above objects and advantages, as well as further objects and advantages, are attained by the present invention which may be described briefly as an articulated gravity feed module including a chute for holding items for sale; a mounting assembly for mounting the chute to a wall; a hopper for supplying the items to the chute, the hopper including an elongated enclosure having an open upper end through which the items can be supplied for restocking and an open lower end which is always open to the chute for depositing the items on the chute; and pivot pins for pivotally securing the hopper to the chute at a position above the chute, such that the hopper is pivotable between an upright dispensing position in which the open upper end of the hopper is positioned adjacent the wall and a restocking position in which the open upper end of the hopper is positioned away from the wall.

Preferably, the chute has a curved bottom wall for receiving the items from the hopper, with the curved bottom wall having a front portion and a rear portion, the radius of curvature of the curved bottom wall decreasing from the rear portion to the front portion. The chute further includes side walls connected with the bottom wall for preventing escape of the items deposited on the bottom wall.

The elongated enclosure is formed by a rear wall, a front wall and side walls which interconnect the rear wall and the front wall, and the rear wall has a lower portion with a radius of curvature similar to the radius of curvature of the rear portion of the bottom wall of the chute so that the lower portion of the rear wall can ride along the rear portion of the bottom wall of the chute.

The pivot pins pivotally connect a front lower portion of the hopper to upper portions of the side walls.

In addition, a limit mechanism is provided for limiting pivotal movement of the hopper with respect to the chute. The limit mechanism includes an elongated slot in the rear portion of the bottom wall of the chute and a stop pin mounted on the lower portion of the rear wall for engagement within the elongated slot.

Finally, a latch is provided for releasably latching the hopper in the dispensing position.

BRIEF DESCRIPTION OF THE DRAWING

The invention will be understood more fully, while still further objects and advantages will become apparent, in the following detailed description of a preferred embodiment of the invention illustrated in the accompanying drawing, in which:

FIG. 1 is a perspective view of a plurality of articulated gravity feed modules according to the present invention, mounted on a common wall in close proximity to each other;

FIG. 4 is a rear plan view of a portion of an articulated gravity feed module.

DESCRIPTION OF THE PREFERRED EMBODIMENT

Figure 3:
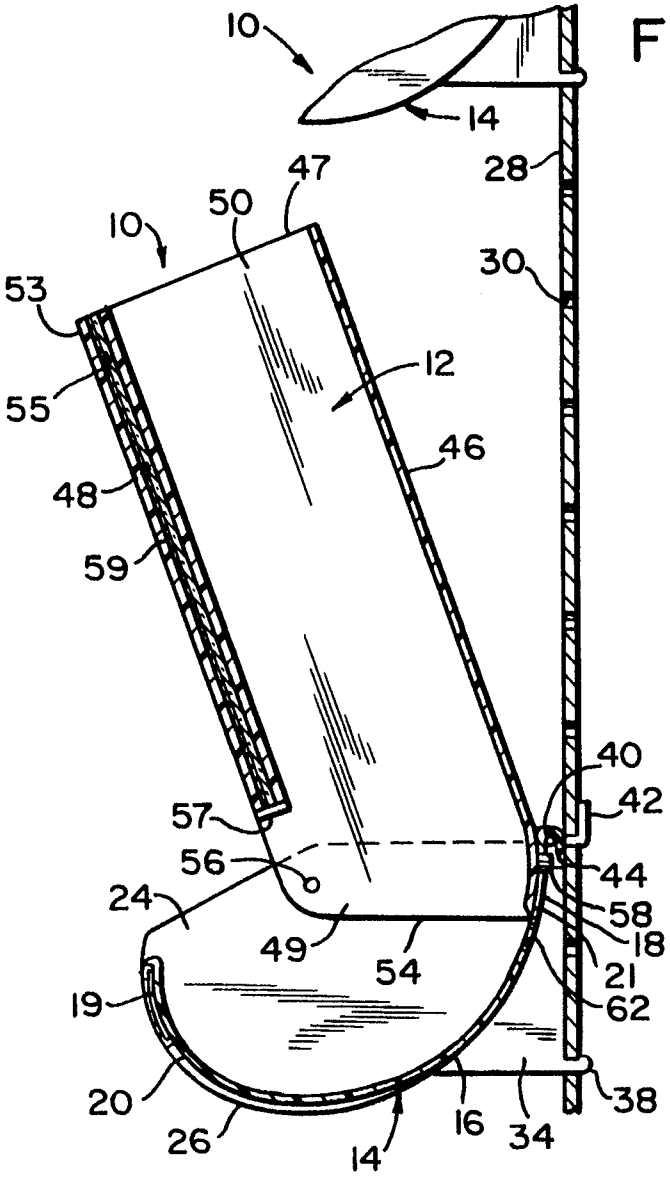
FIG. 3 is a longitudinal cross-sectional view of another articulated gravity feed module of FIG. 1, shown in a tilted restocking position.

Referring now to the drawing, an articulated gravity feed module, constructed in accordance with the present invention, is illustrated generally at 10. Articulated gravity feed module 10 includes an elongated hopper 12 within which items 13 for sale, are held in a loose stacked relation, and a lower curved hook-like chute 14 positioned below hopper 12.

Specifically, chute 14 includes a curved bottom wall 16 with a rear portion 18 having a radius of curvature that approximates a straight line and a front portion 20 with a much smaller radius of curvature. Since bottom wall 16 is continuous, the radius of curvature therefore decreases from rear portion 18 to front portion 20. It will be appreciated that the small radius of curvature of front portion 20 retards the feed of items 13 from hopper 12. Further, as shown, rear portion 18 and front portion 20 are both substantially vertically-oriented at their ends. As a result, and because the radius of curvature of front portion 20 is much smaller than that of rear portion 18, rear portion 18 extends upwardly a greater distance than front portion 20. A price channel 19 may be placed in the front portion 20. As shown best in FIG. 4, bottom wall 16 is also provided with a centrally-located elongated slot 21 in rear portion 18, and which extends in a direction from rear portion 18 toward front portion 20, the purpose for which will become readily apparent from the discussion which follows.

In addition, chute 14 includes opposite side walls 22 and 24 secured to opposite sides of bottom wall 16. Each side wall 22 and 24 has a lower edge 26 with a curvature substantially identical to that of bottom wall 16, such that side walls 22 and 24 are secured to the opposite sides of bottom wall 16 adjacent lower edges 26.

In order to mount chute 14 on a wall 28 having openings 30 arranged in horizontal rows 32, such as a pegboard or the like, rearwardly extending wings 34 are secured to the bottom surface of bottom wall 16 at positions spaced slightly inwardly from side walls 22 and 24 and parallel thereto. The rear edge 36 of each wing 34 forms a straight edge which is vertically oriented when chute 14 is mounted on wall 28 and thereby rests flush against wall 28. A lower tab 38 is connected with rear edge 36 at the lower end thereof and extends rearwardly for engagement into one opening 30.

In addition, a support bar 40 is provided and has L-shaped hooks 42 connected at opposite ends, with L-shaped hooks 42 being mounted in openings 30 of the same horizontal row 32. An inverted U-shaped hook 44 forms an extension of a middle portion of the upper rear edge of bottom wall 16, and is engageable on support bar 40.

To removably mount a chute 14 on wall 28, L-shaped hooks 42 are inserted within openings 30 of the same horizontal row 32 so as to mount support bar 40 in spaced parallel relation to wall 28. Then, inverted U-shaped hook 44 is positioned so as to engage and rest upon support bar 40. Chute 14 is then tilted downwardly so that lower tabs 38 fall into openings 30 of a lower horizontal row 32. To remove chute 14, the reverse operation is performed.

It will be appreciated, of course, that many different variations can be provided for mounting chute 14 on wall 28. For example, L-shaped hooks 42 can be integrally formed with chute 14. Further, wings 34 can be formed as extensions of side walls 22 and 24.

Hopper 12 is preferably formed in an elongated box-like configuration, although any other suitable elongated closed configuration can be used. In this regard, hopper 12 includes a rear wall 46, a transparent front wall 48, and side walls 50 and 52 interconnecting rear wall 46 and front wall 48 in a parallel, spaced relation. Hopper 12 is provided with an upper open end 47 and an lower open end 49. Thus, hopper 12 is formed by an elongated enclosure having open upper end 47 through which items 13 can be supplied for restocking and open lower end 49 which is always open to chute 14 for depositing items 13 on chute 14.

Figure 2:
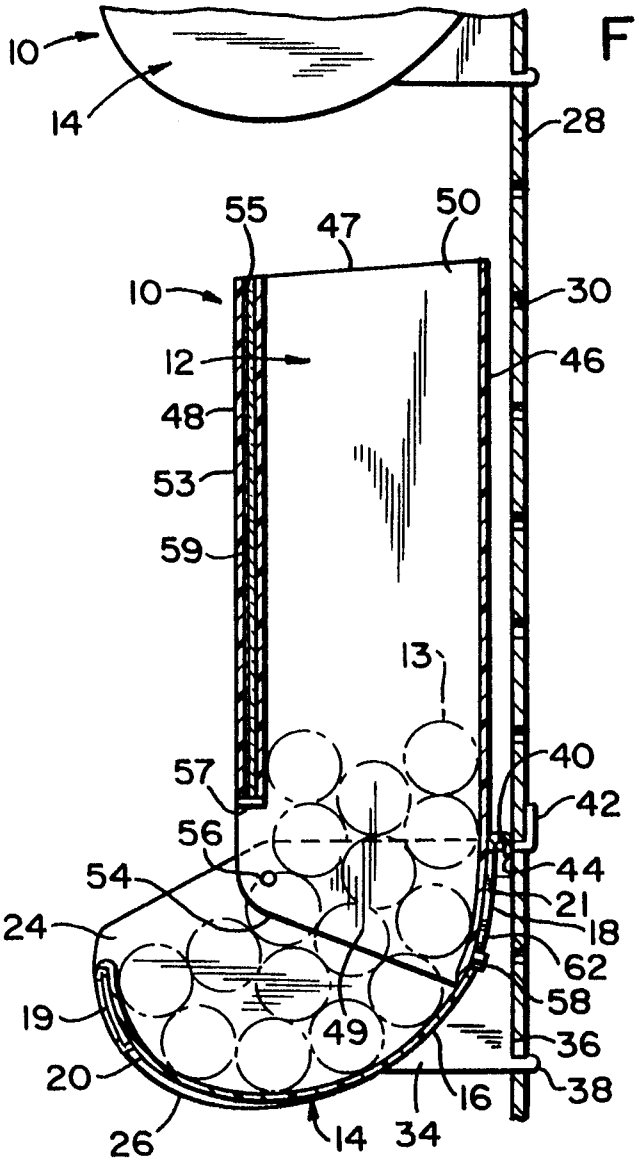
FIG. 2 is a longitudinal cross-sectional view of one articulated gravity feed module of FIG. 1, shown in a mounted dispensing position.

As shown best in FIGS. 2 and 3, rear wall 46 has a greater length than front wall 48 and extends lower than front wall 48. As a result, the lower edges 54 of side walls 50 and 52 are inclined downwardly from the front to the rear when hopper 12 is in the dispensing position of FIG. 2. Further, the front edges of side walls 50 and 52 extend inwardly to form flanges 53 in spaced, parallel relation in front of front wall 48, thereby forming channels 55 for receiving and retaining a display panel 59 carrying information, such as a description, price, graphics and the like, pertaining to items 13. Channels 55 are closed at their lower ends by tabs 57 or the like.

The distance between the outer surfaces of side walls 50 and 52 is less than the distance between the inner surfaces of side walls 22 and 24. Accordingly, hopper 12 can fit within chute 14. In order to pivotally secure hopper 12 to chute 14, the lower ends of side walls 50 and 52 are positioned between side walls 22 and 24 of chute 14, and the front lower ends of side walls 50 and 52 are connected substantially centrally to upper ends of side walls 22 and 24, respectively, by pivot pins 56. Accordingly, hopper 12 can pivot between the dispensing position shown in FIG. 2 and the restocking position shown in FIG. 3.

In this regard, the lower end of rear wall 46 rides along the inner surface of rear portion 18 of bottom wall 16 during such pivoting movement. In accordance with the present invention, the lower end of rear wall 46 has substantially the same curvature as rear portion 18.

In order to limit the extent of such pivoting action, a stop pin 58 is mounted to the outer surface at the lower end of rear wall 46, and engages within elongated slot 21, thereby limiting the pivoting action to a range between the dispensing position shown in FIG. 2 and the restocking position shown in FIG. 3. A latch 60 is provided so as to releasably latch hopper 12 in the dispensing position shown in FIG. 2. Latch 60 includes detents 62 integral with the bottom wall 16 and located adjacent an end 64 of the slot 21 for releasably maintaining stop pin 58 at the position shown in FIG. 4, at which position the hopper 12 is latched in the dispensing position. Relief openings 66 are placed in bottom wall 16 adjacent each detent 62 to facilitate resilient deflection of the detents 62 upon deliberate movement of the hopper 12 out of latched retention at the dispensing position and toward the restocking position shown in FIG. 3.

In view of the above description, it will be appreciated that a plurality of articulated gravity feed modules 10 can be placed in close proximity to each other, as shown in FIG. 1, without hindering the removal of items from chutes 14 and without hindering restocking of items 13 into hoppers 12. This is because each elongated hopper 12 is tiltable or pivotable about pivot pins 56 to move the upper open end 49 outwardly of wall 28 to the restocking position of FIG. 3. Because each hopper 12 is formed as an enclosure, there is no need to use a removable backing plate, but rather, the hoppers can be restocked from the open upper ends thereof.

Further, the lower rear wall of hopper 12 is slidably engaged with the upper rear wall of chute 14, and thereby pivots along the radius of the upper rear wall of chute 14. This means that the rear walls of hopper 12 and chute 14 always form an effectively continuous wall having a smooth transition.

Still further, because the lower end 49 of hopper 12 is always open, items 13 are always deposited immediately upon the upper surface of chute 14 for removal by a purchaser. There is thus no need for any additional mechanism to release the items onto chute 14.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. An articulated gravity feed module comprising:

chute means for holding items for sale;

mounting means for mounting said chute means to a wall;

hopper means for supplying said items to said chute means, said hopper means including an elongated enclosure having an open upper end through which said items can be supplied for restocking and an open lower end which is always open to said chute means for depositing said items on said chute means; and pivot means for pivotally securing said hopper means to said chute means at a position above said chute means, such that said hopper means is pivotable between an upright dispensing position in which the open upper end of said hopper means is positioned adjacent said wall and a restocking position in which the open upper end of said hopper means is positioned away from said wall;

said chute means having a curved bottom wall for receiving said items from said hopper means, and side walls connected with said bottom wall for preventing escape of said items deposited on said bottom wall; and said pivot means including at least one pivot pin for pivotally connecting a front lower portion of said hopper means to upper portions of said side walls;

said curved bottom wall having a front portion and a rear portion including a radius of curvature, said elongated enclosure being formed by a rear wall, a front wall and side walls which interconnect said rear wall and said front wall, and said rear wall having a lower portion with a radius of curvature similar to the radius of curvature of the rear portion of the bottom wall of said chute means so that said lower portion of said rear wall can ride along said rear portion of said bottom wall of said chute means during pivoting movement.

2. An articulated gravity feed module according to claim 1, further including limit means for limiting pivotal movement of said hopper means with respect to said chute means.

3. An articulated gravity feed module according to claim 2, wherein said limit means includes an elongated slot in said rear portion of said bottom wall of said chute means and stop pin means mounted on said lower portion of said rear wall for engagement within said elongated slot.

4. An articulated gravity feed module according to claim 1, further including latch means for releasably latching said hopper means in said dispensing position.

5. An articulated gravity feed module according to claim 1, wherein the radius of curvature of said curved bottom wall decreases from said rear portion to said front portion.

* * * * *